US006210102B1

(12) United States Patent
Yu et al.

(10) Patent No.: US 6,210,102 B1
(45) Date of Patent: Apr. 3, 2001

(54) REGENERATIVE FUEL PUMP HAVING FORCE-BALANCED IMPELLER

(75) Inventors: DeQuan Yu, Ann Arbor; Ronald Luce Verkleeren, Dearborn, both of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/415,095

(22) Filed: Oct. 8, 1999

(51) Int. Cl.[7] ..... F04D 1/04
(52) U.S. Cl. ..... 415/55.1; 416/236 R
(58) Field of Search ..... 415/55.1, 55.2, 415/55.3, 55.4; 416/106, 235, 236 R, 231 R; 417/366, 368

(56) References Cited

U.S. PATENT DOCUMENTS

| | | | |
|---|---|---|---|
| 3,768,920 | 10/1973 | Gerwin | 415/148 |
| 3,851,998 | 12/1974 | Downing | 417/199 A |
| 4,586,877 | 5/1986 | Watanabe et al. | 417/365 |
| 4,854,830 | 8/1989 | Kozawa et al. | 417/365 |
| 4,872,806 | 10/1989 | Yamada et al. | 415/55.5 |
| 5,137,418 | 8/1992 | Sieghartner | 415/55.1 |
| 5,415,521 | 5/1995 | Hufnagel et al. | 415/55.1 |
| 5,601,398 | 2/1997 | Treibner et al. | 415/55.1 |
| 5,607,283 | 3/1997 | Kato et al. | 415/55.1 |
| 5,921,746 * | 7/1999 | Yu et al. | 415/55.2 |

* cited by examiner

*Primary Examiner*—Edward K. Look
(74) *Attorney, Agent, or Firm*—Mark Mollon

(57) ABSTRACT

A pump (10) has a housing containing an internal pumping chamber (30). A fluid inlet (32) and a fluid outlet (34) are spaced arcuately apart about an axis (12), and an impeller (20) within the housing rotates about the axis to pump fluid from the inlet to the outlet. The impeller has mutually parallel opposite faces (40, 42) circumferentially bounded by a vaned periphery (38). The impeller has a pattern of through-holes (46) extending between its faces and the one face that confronts a wall surface of the housing to which the inlet is proximate has, in association with each through-hole, a groove (44) that adjoins and tails circumferentially away from the respective through-hole in a sense opposite the sense in which the impeller rotates to pump fluid from the inlet to the outlet. The groove inclines and provides a reaction surface against which fluid exerts a lifting force to aid in force-balancing the impeller.

20 Claims, 2 Drawing Sheets

REGENERATIVE FUEL PUMP HAVING FORCE-BALANCED IMPELLER

BACKGROUND OF THE INVENTION

1) Field of the Invention

This invention relates generally to pumps, and in particular to a regenerative fuel pump having a vaned impeller. Such a pump is useful as an electric-motor-operated fuel pump for an automotive vehicle to pump liquid fuel from a fuel tank through a fuel handling system to an engine that powers the vehicle.

2) Background Information

In an automotive vehicle that is powered by an internal combustion engine, fuel may be pumped through a fuel handling system of the engine by an in-tank, electric-motor-operated fuel pump.

Examples of fuel pumps are shown in various patents, including U.S. Pat. Nos. 3,851,998; 5,310,308; 5,409,357; 5,415,521; 5,551,875; and 5,601,398. Commonly owned U.S. Pat. Nos. 5,310,308; 5,409,357; and 5,551,835 disclose pumps of the general type to which the present invention relates, and such pumps provide certain benefits and advantages over certain other types of pumps.

For developing pressures suitable for a vehicle fuel system, the impeller of a regenerative pump may have very close running tolerances to the walls of the pump parts that axially confront opposite faces of the impeller internally of the pump. Hence, dimensional stability of materials is an important design consideration, and certain materials have been found particularly suitable for the impeller and for the parts of the pump (a pump cover and a pump body, for example) that confront it. PPS and phenolic are examples of suitable impeller materials; those two materials, as well as aluminum, are suitable for the pump cover and pump body.

A representative pump is a wet pump that comprises an inlet in the pump cover and an outlet in the pump body. The inlet and the outlet are open to an annular pumping chamber that runs around the perimeter of the pump. The impeller comprises vanes that rotate within the pumping chamber to move fluid from the inlet to the outlet. When the pump is disposed within a fuel tank with its axis generally vertical and the cover facing a bottom wall of the tank, the inlet is open to liquid fuel in the tank. When the pump is operated by an associated electric motor, some pressure difference is developed across those portions of the impeller faces which are disposed radially inward of the annular pumping chamber and which have close running fits to confronting wall surfaces of the pump cover and the pump body, thus creating a force imbalance that acts on the impeller in a downward direction. The force of gravity is additive to that downward force imbalance. Force imbalance may act on an impeller in ways that increase running friction. Such friction may decrease pump efficiency and accelerate wear that leads to even further loss of pumping efficiency.

Various solutions have been proposed to minimize, and ideally eliminate, force imbalance acting on the impeller. Examples are found in U.S. Pat. Nos. 3,768,920; 4,586,877; 4,854,830; 4,872,806; 5,137,418; and 5,607,283.

SUMMARY OF THE INVENTION

Through continuing development, it has been discovered the inclusion of certain features in an impeller can provide a better solution to the force imbalance problem described above.

Because those features are incorporated in the impeller, they can be inherently created when an impeller that embodies them is fabricated by known impeller fabrication methods. Hence, the solution provided by the present invention is significantly cost-effective.

Briefly, the invention relates to the inclusion of what the inventors have called "lifting tail grooves" in association with force-balance through-holes that extend between opposite impeller faces. The lifting tail grooves are provided in the face of the impeller that is toward the pump inlet, sometimes herein called the down-face for convenience because it faces down when the pump is mounted inside a fuel tank in the manner mentioned above. Each lifting tail groove comprises a shaped cavity that adjoins a respective force-balance through-hole, and runs a short distance circumferentially in a sense that is opposite the sense in which the impeller is rotating. Hence each groove "tails away" from the respective through-hole.

Importantly, each lifting tail groove comprises a fluid reaction surface that is non-parallel to the plane of the impeller down-face. It is believed that as the impeller rotates, fluid lamina between the impeller down-face and the confronting wall surface of the pump cover tends to rotate in the same sense as the impeller, but at a slower velocity because of its inherent viscosity. Hence, it is believed that the fluid lamina tends to rotate counter-clockwise relative to the impeller.

After the fluid lamina has passed across a force-balance through-hole and begins to encounter the respective lifting tail groove, it acts on the fluid reaction surface of the lifting tail groove in a manner that has been found to create a useful upward component of force that is opposite the pressure-induced force imbalance acting on the impeller. This effect significantly improves force-balancing of the impeller.

A representative impeller may have a number of identical force-balance through-holes distributed in a uniform pattern with respect to the impeller axis. Identical lifting tail grooves are associated with the force-balance through-holes.

One general aspect of the present invention relates to a pump comprising: a pump housing comprising an internal pumping chamber and a fluid inlet to, and a fluid outlet from, the pumping chamber spaced arcuately apart about an axis; and a pumping element that is disposed within the housing for rotation about the axis and that has a body comprising a vaned periphery operable with respect to the pumping chamber to pump fluid from the inlet to the outlet when the pumping element is rotated, the pumping element body further having mutually parallel opposite faces circumferentially bounded by its vaned periphery. The pump housing comprises wall surfaces confronting the opposite faces of the pumping element body with close running clearance, the inlet being proximate one wall surface and the outlet being proximate the other wall surface. The pumping element body comprises a pattern of through-holes extending between its faces with the one face that confronts the wall surface to which the inlet is proximate further comprising in association with each through-hole, a groove that adjoins and tails circumferentially away from the respective through-hole in a sense opposite the sense in which the pumping element rotates to pump fluid from the inlet to the outlet and that inclines from the through-hole to end by merging with the one face of the pumping element body at a location spaced circumferentially from the respective through-hole.

Another general aspect relates to a pump comprising: a pump housing comprising an internal pumping chamber and a fluid inlet to, and a fluid outlet from, the pumping chamber spaced arcuately apart about an axis; and a pumping element that is disposed within the housing for rotation about the axis and that has a body comprising a vaned periphery operable with respect to the pumping chamber to pump fluid from the inlet to the outlet when the pumping element is rotated, the pumping element body further having mutually parallel opposite faces circumferentially bounded by its vaned periphery. The pump housing comprises wall surfaces confronting the opposite faces of the pumping element body with close running clearance, the inlet being proximate one wall surface and the outlet being proximate the other wall surface. The pumping element body comprises a pattern of through-holes that have wall surfaces extending parallel to the pump axis between its faces with the one face that confronts the wall surface to which the inlet is proximate further comprising in association with each through-hole, a groove that adjoins and tails circumferentially away from the respective through-hole along an arc that is concentric with the pump axis in a sense opposite the sense in which the pumping element rotates to pump fluid from the inlet to the outlet, and that merges with the one face of the pumping element body at a location spaced circumferentially from the respective through-hole.

Other general and more specific aspects will been set forth in the ensuing description and claims.

BRIEF DESCRIPTION OF THE DRAWINGS

The drawings that will now be briefly described are incorporated herein to illustrate a preferred embodiment of the invention and a best mode presently contemplated for carrying out the invention.

DESCRIPTION OF THE PREFERRED EMBODIMENT

Figure 1:
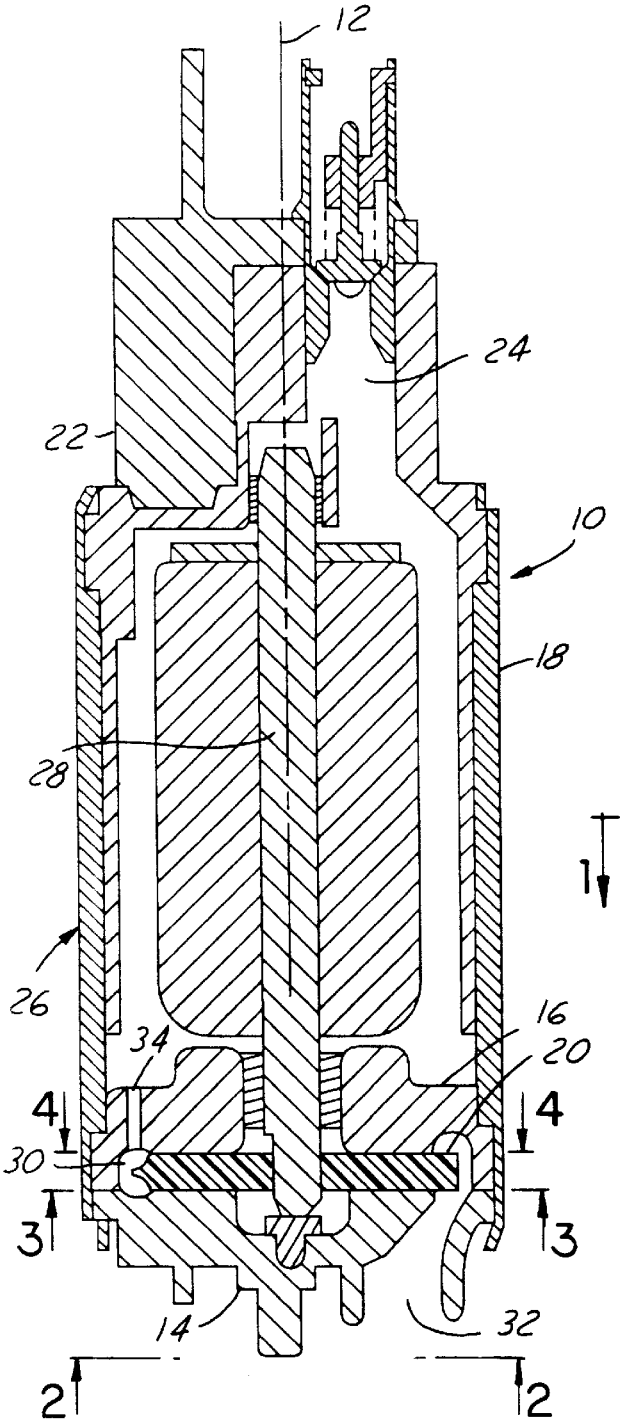
FIG. 1 is a longitudinal cross section view of a fuel pump embodying principles of the invention, as taken in the direction of arrows 1—1 in FIG. 2.
Figure 2:
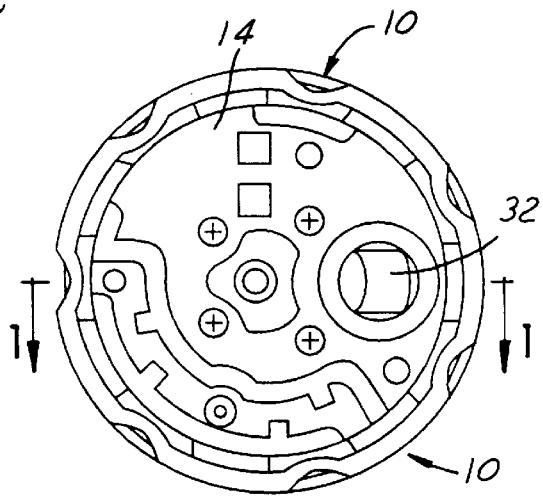
FIG. 2 is an end view taken in the direction of arrows 2—2 in FIG. 1.
Figure 3:
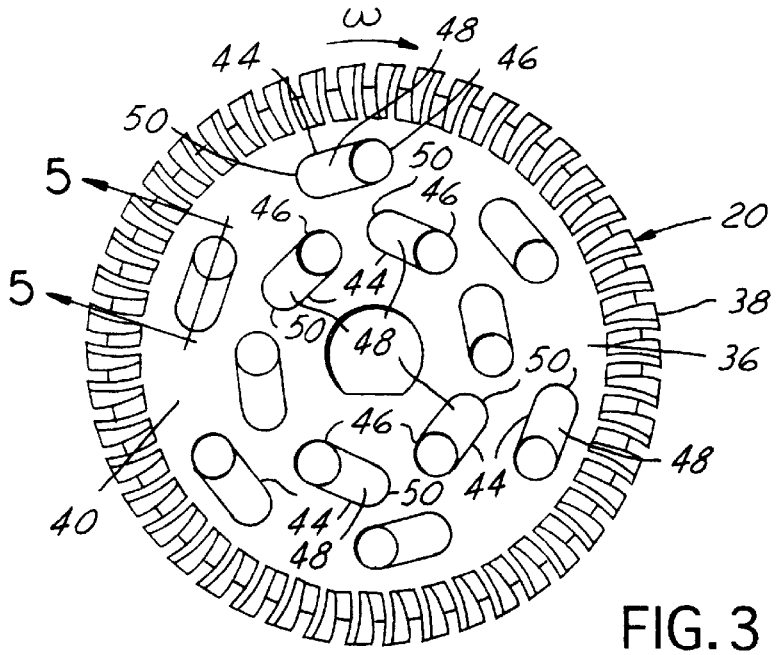
FIG. 3 is a full plan view of one face of an impeller of the pump of FIGS. 1 and 2, as taken in the direction of arrows 3—3 in FIG. 1 and enlarged.
Figure 4:
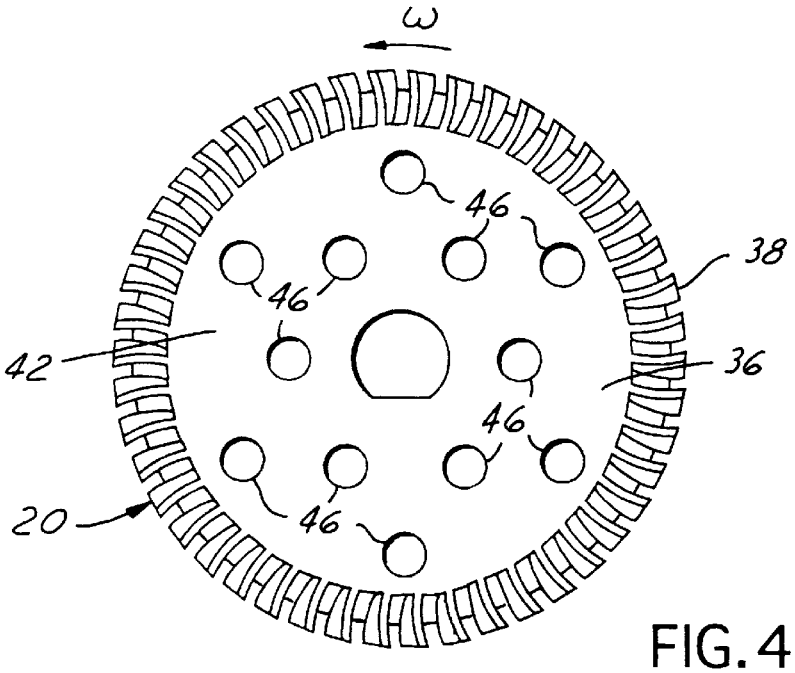
FIG. 4 is a full plan view of an opposite face of the impeller, as taken in the direction of arrows 4—4 in FIG. 1 and enlarged.

FIGS. 1 and 2 show an automotive vehicle fuel pump 10 embodying principles of the present invention and having an imaginary longitudinal axis 12. Pump 10 comprises a housing that includes a pump cover 14 and a pump body 16 cooperatively arranged to close off one axial end of a cylindrical sleeve 18 and to cooperatively define an internal space for a pumping element, specifically an impeller 20, that can rotate about axis 12. The opposite axial end of sleeve 18 is closed by a part 22 that contains an exit tube 24 via which fuel exits pump 10. Part 22 is spaced from pump body 16 to provide an internal space for an electric motor 26 that rotates impeller 20 when pump 10 runs. Motor 26 comprises an armature including a shaft 28 journaled for rotation about axis 12 and having a keyed connection at one end for imparting rotational motion to impeller 20. The internal space cooperatively defined by pump cover 14 and pump body 16 for impeller 20 includes an annular pumping chamber 30.

Pump 10 is intended to be at least partially submerged in a fuel tank of an automotive vehicle for running wet. A passage that extends through pump cover 14 provides an inlet 32 to pumping chamber 30. A passage that extends through pump body 16 provides an outlet 34 from pumping chamber 30. Fuel that leaves outlet 34 passes through motor 26 and exits pump 10 via tube 24 from whence the fuel is pumped to an engine through an engine fuel handling system (not shown).

Pumping chamber 30 has a typical circumferential extent of more than 270°, but less than 360°, with inlet 32 at one end of the pumping chamber and outlet 34 at the opposite end. Hence, outlet 34 is shown out of position in FIG. 1. Impeller 20 comprises a circular body 36 having a series of circumferentially spaced apart vanes 38 around its outer periphery. As impeller 20 is rotated by motor 26, its vaned periphery rotates through pumping chamber 30 to create a pressure differential between inlet 32 and outlet 34 that draws fluid through inlet 32, moves the fluid through pumping chamber 30, and forces the fluid out through outlet 34.

The portion of impeller body 36 that is surrounded by vanes 38 comprises flat, mutually parallel, opposite faces 40, 42 that are perpendicular to axis 12. Face 40 is a down-face that is confronted by a wall surface of pump cover 14, and face 42 is an up-face that is confronted by a wall surface of pump body 16. Those wall surfaces of cover 14 and pump body 16 confront the opposite faces 40, 42 of the pumping element body with close running clearance.

In accordance with the inventive principles, FIGS. 35 show "lifting tail grooves" 44 associated with force-balance through-holes 46 that extend between opposite impeller faces 40, 42. A representative impeller, like the one shown, may have a number of identical force-balance through-holes 46 distributed in a uniform pattern with respect to axis 12. Impeller 20 has two circular rows of identical circular through-holes 46, one concentric within the other relative to axis 12, each row containing six through-holes 46 centered at 60° intervals about axis 12.

The through-holes of one row are circumferentially offset 30° from those of the other row. The through-holes are straight, with their axes being parallel to axis 12.

Identical lifting tail grooves 44 are associated with through-holes 46. Lifting tail grooves 44 are provided in down-face 40 of impeller 20, but not in up-face 42. Each lifting tail groove 44 is a shaped cavity that adjoins a respective force-balance through-hole 46, and runs a short distance circumferentially in a sense that is opposite the sense in which the impeller rotates to pump fluid from inlet 32 to outlet 34. Each groove may be considered to have an imaginary axis that extends generally circumferentially from the center of the respective through-hole 46. That axis may be substantially straight, as shown in the drawing, or slightly curved, such as following a circular arc that is concentric with axis 12. Hence in any case, each groove 44 may be said to "tail away" from the respective through-hole 46.

Figure 5:
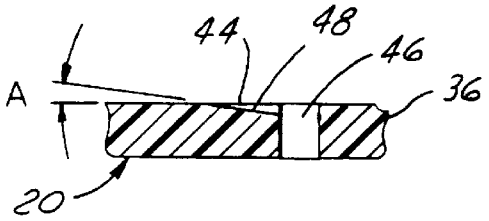
FIG. 5 is a fragmentary cross section view taken in the direction of arrows 5—5 in FIG. 3.

As viewed in plan, each lifting tail groove 44 has a radial dimension, i.e. width, that is substantially equal to the diameter of the respective through-hole 46 from which it tails away, and ends in a generally semi-circular edge 50 as it merges with down-face 40. Importantly, each lifting tail groove 44 comprises a fluid reaction surface 48 that is nonparallel to the plane of down-face 40. As marked on FIG. 5, reaction surface 48 is disposed at a small acute angle A (slightly exaggerated in FIG. 5 for purposes of illustration) with respect to the plane of down-face 40. Examples of angles that are believed most suitable range from about 1° to about 3°. While excessive inclination that may impair effectiveness of reaction surface 48 should be avoided, angles as large as 7° to 10° may be effective in certain pump designs.

Where lifting tail groove 44 adjoins through-hole 46, the depth of surface 48 may range up to about 1.0 mm, but about 0.2 mm to about 0.4 mm is a preferred range based on development of an impeller as shown in the drawings. Surface 48 inclines upward toward the plane of down-face 40 along its circumferential extent from through-hole 46, finally merging with the flat planar surface of the down-face along a generally semi-circular edge 50 that ends some 30° clockwise from the corresponding through-hole. Surface 48 may be flat, substantially flat, or slightly concave.

It is believed that as the impeller rotates, fluid lamina between the impeller down-face and the confronting wall surface of the pump cover tends to rotate in the same sense as the impeller, but at a slower velocity because of its inherent viscosity. Hence, it is believed that the fluid lamina tends to rotate counter-clockwise relative to the impeller.

After the fluid lamina has passed across a force-balance through-hole and begins to encounter the respective lifting tail groove, it acts on the fluid reaction surface of the lifting tail groove in a manner that has been found to create a useful upward component of force that is opposite the pressure-induced force imbalance acting on the impeller. This effect significantly improves force-balancing of the impeller. To the extent that there is a component of force acting circumferentially on surface 48, it is believed to act in the same way as circumferential force caused by fluid viscosity as the impeller rotates.

While a presently preferred embodiment has been illustrated and described, it is to be appreciated that the invention may be practiced in various forms within the scope of the following claims.

What is claimed is:

1. A pump comprising:

a pump housing comprising an internal pumping chamber and a fluid inlet to, and a fluid outlet from, the pumping chamber spaced arcuately apart about an axis; and a pumping element that is disposed within the housing for rotation about the axis and that has a body comprising a vaned periphery operable with respect to the pumping chamber to pump fluid from the inlet to the outlet when the pumping element is rotated, the pumping element body further having mutually parallel opposite faces circumferentially bounded by its vaned periphery;

the pump housing comprising wall surfaces confronting the opposite faces of the-pumping element body with close running clearance, the inlet being proximate one wall surface and the outlet being proximate the other wall surface;

the pumping element body comprising a pattern of through-holes extending between its faces with the one face that confronts the wall surface to which the inlet is proximate further comprising in association with each through-hole, a groove that adjoins and tails circumferentially away from the respective through-hole in a sense opposite the sense in which the pumping element rotates to pump fluid from the inlet to the outlet, and that inclines from the through-hole to end by merging with the one face of the pumping element body at a location spaced circumferentially from the respective through-hole.

2. A pump as set forth in claim 1 in which each groove comprises a cavity having a reaction surface that inclines from the through-hole along a slope not greater than about 10°.

3. A pump as set forth in claim 2 in which each groove comprises a cavity having a reaction surface that inclines from the through-hole along a substantially constant slope within a range from about 1° to about 3°.

4. A pump as set forth in claim 2 in which the reaction surface of at least some of the cavities is flat.

5. A pump as set forth in claim 2 in which the reaction surface of at least some of the cavities is concave as viewed in radial cross section.

6. A pump as set forth in claim 2 in which the reaction surface of at least some of the cavities is disposed at a depth not greater than about 1.0 mm where it adjoins the respective through-hole.

7. A pump as set forth in claim 6 in which the reaction surface of at least some of the cavities is disposed at a depth within a range from about 0.2 mm to about 0.4 mm where it adjoins the respective through-hole.

8. A pump as set forth in claim 7 in which at least some of the through-holes are circular and have axes parallel to the pump axis.

9. A pump as set forth in claim 2 in which the reaction surface of at least some of the cavities merges with the one face of the pumping element body along a generally semi-circular edge.

10. A pump as set forth in claim 1 in which the through-holes are arranged in plural, mutually concentric circular rows that are also concentric with the pump axis, each row containing circular through-holes spaced uniformly about the pump axis.

11. A pump as set forth in claim 10 in which the through-holes of one row are circumferentially offset from those of another row.

12. A pump as set forth in claim 1 in which at least some of the grooves tail away along a circular arc that is concentric with the pump axis.

13. A pump comprising:

a pump housing comprising an internal pumping chamber and a fluid inlet to, and a fluid outlet from, the pumping chamber spaced arcuately apart about an axis; and a pumping element that is disposed within the housing for rotation about the axis and that has a body comprising a vaned periphery operable with respect to the pumping chamber to pump fluid from the inlet to the outlet when the pumping element is rotated, the pumping element body further having mutually parallel opposite faces circumferentially bounded by its vaned periphery;

the pump housing comprising wall surfaces confronting the opposite faces of the pumping element body with close running clearance, the inlet being proximate one wall surface and the outlet being proximate the other wall surface;

the pumping element body comprising a pattern of through-holes that have wall surfaces extending parallel to the pump axis between its faces with the one face that confronts the wall surface to which the inlet is proximate further comprising in association with each through-hole, a respective groove that adjoins and tails circumferentially away from the respective through-hole along an arc that is concentric with the pump axis in a sense opposite the sense in which the pumping element rotates to pump fluid from the inlet to the outlet, and that merges with the one face of the pumping element body at a location spaced circumferentially from the respective through-hole.

14. A pump as set forth in claim 13 in which each groove comprises a cavity having a reaction surface that inclines from the through-hole along a slope not greater than about 10°.

15. A pump as set forth in claim 14 in which at least some of the grooves comprise a cavity having a reaction surface that inclines from the respective through-hole along a substantially constant slope within a range from about 1° to about 3°.

16. A pump as set forth in claim 14 in which the reaction surface of at least some of the cavities is flat.

17. A pump as set forth in claim 14 in which the reaction surface of at least some of the cavities is concave as viewed in radial cross section.

18. A pump as set forth in claim 14 in which the reaction surface of at least some of the cavities is disposed at a depth not greater than about 1.0 mm where it adjoins the respective through-hole.

19. A pump as set forth in claim 18 in which the reaction surface of at least some of the cavities is disposed at a depth within a range from about 0.2 mm to about 0.4 mm where it adjoins the respective through-hole.

20. A pump as set forth in claim 13 in which at least some of the through-holes are circular in cross section, and the respective groove adjoins a through-hole of circular cross section along a semi-circumference of the throughhole.

* * * * *